US012509775B2

(12) United States Patent
Ruhl et al.

(10) Patent No.: US 12,509,775 B2
(45) Date of Patent: Dec. 30, 2025

(54) CHROMIUM(VI)-FREE COATING AGENT FOR METALS

(71) Applicant: M-M-MORANT-GMBH, Bernau (DE)

(72) Inventors: Alexander Ruhl, Bernau (DE); Max Mordant, Bernau (DE)

(73) Assignee: M-M-MORANT-GMBH, Bernau (DE)

( * ) Notice: Subject to any disclaimer, the term of this patent is extended or adjusted under 35 U.S.C. 154(b) by 358 days.

(21) Appl. No.: 18/036,896

(22) PCT Filed: Nov. 4, 2021

(86) PCT No.: PCT/EP2021/080585

§ 371 (c)(1),
(2) Date: May 15, 2023

(87) PCT Pub. No.: WO2022/135778

PCT Pub. Date: Jun. 30, 2022

(65) Prior Publication Data

US 2024/0018662 A1 Jan. 18, 2024

(30) Foreign Application Priority Data

Dec. 22, 2020 (DE) ..... 10 2020 134 670.0

(51) Int. Cl.
*C23C 22/16* (2006.01)
*C23C 22/76* (2006.01)

(52) U.S. Cl.
CPC ..... *C23C 22/16* (2013.01); *C23C 22/76* (2013.01)

(58) Field of Classification Search
CPC ..... C23C 22/16; C23C 22/76; C04B 28/34
See application file for complete search history.

(56) References Cited

U.S. PATENT DOCUMENTS

| | | | |
|---|---|---|---|
| 4,606,967 | A | 8/1986 | Mosser |
| 5,011,738 | A | 4/1991 | Saclier |
| 6,530,999 | B2 | 3/2003 | Meagher et al. |
| 2009/0071573 | A1 | 3/2009 | Brouwer et al. |
| 2009/0324983 | A1 | 12/2009 | Hackbarth et al. |
| 2011/0039122 | A1 | 2/2011 | Holzapfel et al. |
| 2011/0180186 | A1 | 7/2011 | Nitschke et al. |
| 2015/0079278 | A1 | 3/2015 | Stapel et al. |

FOREIGN PATENT DOCUMENTS

| | | | | |
|---|---|---|---|---|
| CN | 107418376 | A | 12/2017 | |
| DE | 68910889 | T2 | 5/1994 | |
| DE | 10345801 | A1 | 4/2005 | |
| DE | 102006062500 | A1 | 7/2008 | |
| DE | 102008008781 | A1 | 8/2009 | |
| EP | 0385806 | A1 | 9/1990 | |
| EP | 0995816 | A1 | 4/2000 | |
| GB | 887924 | A * | 1/1982 | ..... C23C 22/16 |
| WO | 2013149609 | A1 | 10/2013 | |

OTHER PUBLICATIONS

International Search Report and Written Opinion (with English translation of International Search Report) issued in corresponding International Patent Application No. PCT/EP2021/080585 mailed Feb. 14, 2022 (12 pages).
Office Action issued in corresponding German Patent Application No. 10 2020 134 670.0 dated Jul. 30, 2021 (8 pages).
Office Action issued in corresponding European Patent Application 21 807 007.6 dated Apr. 15, 2025 (6 pages).

* cited by examiner

*Primary Examiner* — Jessee R Roe

(74) *Attorney, Agent, or Firm* — Kilyk & Bowersox, P.L.L.C.

(57) ABSTRACT

The invention relates to a coating agent for coating acid-sensitive metal surfaces, which is an aqueous solution of an acidic phosphate binder, the coating agent comprising a peroxo compound and being free of chromium (VI) salts. The invention further relates to a method of coating a metal surface with such a coating agent, and to the use of such a coating agent for increasing the corrosion resistance of metal components in various industrial fields.

19 Claims, 4 Drawing Sheets

CHROMIUM(VI)-FREE COATING AGENT FOR METALS

Figures 1A, 1B:
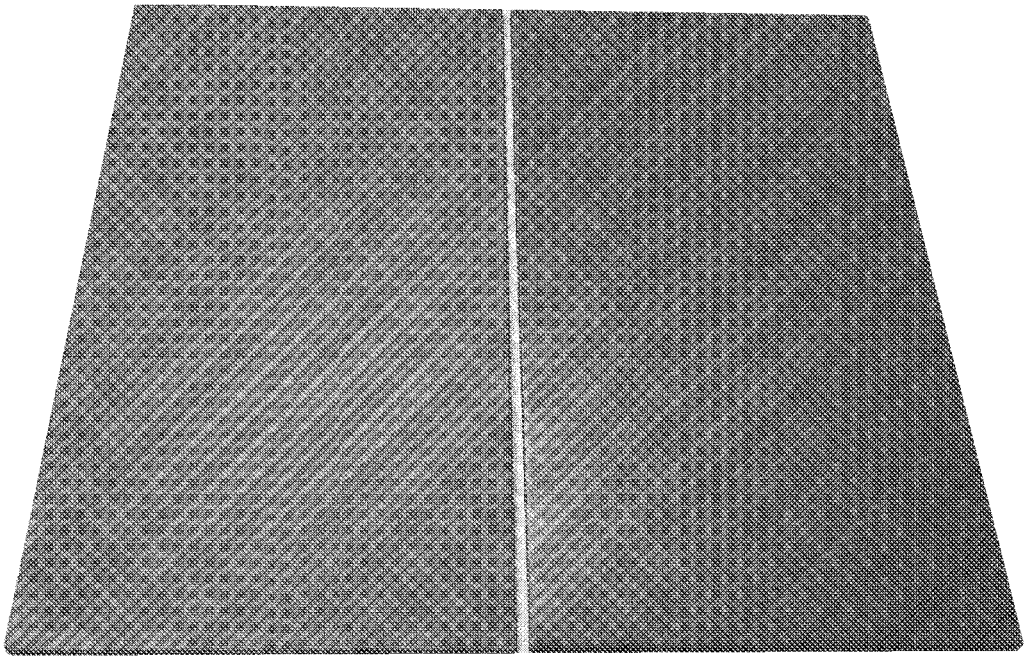

This application is a National Stage Application of PCT/EP2021/080585, filed Nov. 4, 2021, which in turn claims priority to German Patent Application No. 10 2020 134 670.0 filed Dec. 22, 2020.

The present application relates to a chromium(VI)-free, phosphate-based coating agent for coating acid-sensitive metals.

There are various known methods for the corrosion protection of metal surfaces, in which a coating agent based on an aqueous phosphate solution is applied to the metal surface. So-called layer-forming methods comprise building up a thermally and mechanically stable homogeneous phosphate coating that adheres well to the surface by depositing poorly soluble metal phosphates on the metal surface, whereby the ions for precipitation are present in the coating agent itself and are not, as in non-layer-forming methods, in part drawn from the metal surface. Layer-forming slurry compositions have been used for making conductivity coatings of metals. The slurries are obtained by suspending metal powders to the aqueous phosphate solution.

The layer-forming solutions or slurry suspensions can be applied to the surface of metal parts by spraying, brushing or pouring, or by dipping. Application outside of a dip bath is preferred in many cases, firstly because this allows for localized coating, secondly because the coating thickness can be better controlled, and thirdly because the consumption of solution or slurry suspension is lower.

Particularly on ignoble metal surfaces, such as the surfaces of low alloyed steels, etching may occur during the application of phosphate-comprising solutions or slurry suspensions and/or during the drying time, whereby the acidic phosphates (esp. dihydrogen phosphates) react with the metal to form hydrogen gas and phosphate salts. The development of hydrogen gas and the formation of water-soluble salts are problematic. The former phenomenon causes bubbles to form in the phosphate coating and causes the coating to foam and become unstable. The latter phenomenon reduces adhesion and water resistance of the coating.

To prevent such etching and, in the case of slurry suspensions, to simultaneously prevent etching of metal particles suspended in the slurry, the addition of highly oxidized heavy metal salts, in particular chromium(VI) salts, to solutions or slurries of the generic kind was common in the prior art. The chromium(VI) salts had the functions of passivating the substrate surface or oxidation-sensitive metal powder in the slurry and thus protecting it from being etched by the acid of the acid phosphate binder, and accelerating formation of a ceramic-like and temperature-stable polyphosphate network on the substrate surface.

However, the use of chromium(VI) salts should be avoided due to their carcinogenic properties. The use of alternative highly oxidized heavy metal salts is also undesirable for work safety and environmental protection reasons.

The technical problem underlying the invention is providing a phosphate-based coating agent, which is suitable for coating acid-sensitive metals and does not require the addition of chromium(VI) salts or comparable highly oxidized heavy metal salts.

Against this background, the invention relates to a coating agent for coating acid-sensitive metal surfaces, which is an aqueous solution of an acidic phosphate binder. According to the invention, the coating agent comprises a peroxo compound and is free of chromium(VI) salts.

Peroxo compounds are a chemical group of substances comprising a peroxy group (—O—O—) or a peroxide anion (—O—$O^-$ or (O—$O^{2-}$). It was surprisingly found that in layer-forming coating systems, where water-soluble salts formed in the process cannot rinse off with the solvent as in dip baths, a peroxo compound largely inhibits an undesired evolution of hydrogen gas and an undesired formation of water-soluble salts, which would normally result from acid attack on the metal surface by the acid phosphate binder.

The coating agent is a liquid agent and is suitable for layer-forming application to the metal surface, for example by spraying or brushing on. Due to a comparatively high concentration of phosphate salts, preferably greater than 5 wt. %, further preferably greater than 10 wt. % and particularly preferably greater than 15 wt. %, coatings having a thickness of several micrometers can be built. The percentage values refer to the combined weight of the phosphate or (di)hydrogen phosphate anions together with the countercation relative to the total weight of the coating agent. The coating agent is free of chromium(VI) salts, which are classified as a substance of very high concern (SVHC) under the REACH Regulation. Despite the chromium(VI)-free approach, however, the reactivity of the acidic phosphate binder towards the metal surface can be inhibited to such extent that there is no undesirable development of hydrogen gas and thus no formation of bubbles or foam, and also no formation of water-soluble salts, which would reduce the adhesion and water stability of the coating.

Examples of suitable peroxo compounds comprise peroxo salts such as disodium peroxide or zinc peroxide, peroxo acids and their salts such as perborates, for example sodium perborate, perphosphates, for example sodium perphosphate, or percarbonates, for example sodium percarbonate, hydrogen peroxide, or organic peroxo compounds such as urea peroxide. Water-soluble peroxo compounds are generally preferred.

To achieve the described effects, the concentration of the peroxo compound in the coating agent is preferably at least 0.1 wt. %, further preferably between 0.5 wt. % and 10 wt. %, and further preferably from between 1 wt. % and 5 wt. %.

In one embodiment, the pH of the coating agent is pH 1.5 to pH 4.0, more preferably pH 1.8 to pH 3.0, and further preferably pH 2.0 to pH 2.7.

The phosphate binder comprises acidic monohydrogen or dihydrogen phosphates of cations such as, for example, aluminum, magnesium, chromium(III) and/or zinc. For example, two or three of said cations may be present in the phosphate binder as counterions of the acid phosphates. The relative proportion of phosphoric acid, acidic monohydrogen or dihydrogen phosphates, or basic phosphates determines the pH. In a preferred embodiment, chromium(III) cations are present as counterions.

The peroxo compound ensures that even traces of Cr(VI), which can be formed in the coating agent through Cr(III) oxidation, are immediately reduced to keep the coating agent free of Cr(VI).

The solvent of the coating agent is preferably water. Preferably, the coating agent is free of volatile organic solvents, thus eliminating health concerns and explosion hazards and thus a need for cumbersome precautions, such as exhaust systems or recirculating ovens during drying. The water-based approach, with a high concentration of phosphate salts, allows the slurry to air dry on the substrate surface in a short time, and reduces the tendency of the coating to run during drying. The ceramic coating of several micrometers, which is formed from the phosphate binders, is not negatively affected or dissolved by the application of further layers of coating and likewise has no tendency to run. The excellent drying behavior of the system allows for quickly obtaining thick coatings in the range of greater than 100 μm and thus for thick coatings to be formed in just two to three runs, resulting in high throughput rates and cost-efficiency.

In one embodiment, the coating agent is a phosphate ceramic coating that does not comprise metal powder suspended in the aqueous solution of the acidic phosphate binder. Examples comprise sealers, adhesion promoters, or finish coatings.

In one embodiment, the coating agent is a slurry suspension that additionally comprises a metal powder suspended in the aqueous solution of the acidic phosphate binder. Such a slurry suspension can serve, for example, for cathodic corrosion protection of metal surfaces or for diffusion coating of metal surfaces. Examples of suitable metals comprise oxide-forming metals, especially those with a lower oxidation potential than iron, such as aluminum, nickel, chromium, manganese, germanium, silicon, magnesium, tin, titanium or zinc, or alloys, and mixtures thereof.

The mixing ratio of the solution and the suspended metal powder can be between 30:70 and 80:20, preferably between 40:60 and 70:30 (solution:metal powder). A certain minimum concentration of metal powder in the suspension can be required to build up a thick homogeneous and compact coating of, for example, 10-100 μm.

Especially in the case of a suspended metal powder, the additional presence of an alkyne or cycloalkyne in the coating agent may be preferred. Alkynes are aliphatic hydrocarbon compounds having at least one carbon-carbon triple bond (R—C≡C—R) at any position in the molecule. Alkynes with one triple bond form a homologous series with the general molecular formula $C_nH_{2n-2}$, starting with ethyne (n=2). Cyclic hydrocarbon compounds that have at least one carbon-carbon triple bond (R—C≡C—R) in the molecule are called cycloalkynes. Non-aromatic compounds with two or more carbon-carbon triple bonds are considered alkynes or cycloalkynes, respectively, in the context of the present application. The alkynes and cycloalkynes have a high electron density in the region of the carbon-carbon triple bond and therefore tend to attach to suspended metal particles of the coating agent, thus inhibiting acid attack.

The addition of hydroxylated or otherwise substituted alkynes, with possibly multiple substitutions, can be particularly preferred.

To achieve the effects described, the concentration of alkynes or cycloalkynes in the coating agent is preferably at least 0.01 wt. %, further preferably between 0.05 wt. % and 0.3 wt. %.

Again particularly in the case of a suspended metal powder, the coating agent may additionally comprise a reducing agent such as, for example, a thio compound. Examples of suitable thio compounds comprise thiols, thioethers such as thiodiglycol, bisulfites such as potassium metabisulfite, or thiourea.

In one embodiment, the coating agent further comprises ceramic pigments such as, for example, $Al_2O_3$, silica, hydrophilic silica or silica sol. The addition of pigments can be preferred in particular if the coating agent is to be used as a topcoat.

In one embodiment, the coating composition further comprises dispersed PTFE particles. The addition of PTFE particles can be preferred in particular if the coating agent is to be used as a topcoat.

The coating agent may further comprise an anti-settling agent, a thixotropic agent, a thickener, or mixtures thereof.

Preferably, the coating agent is free of oxidizing compounds as often used in generic coating agents. In particular, it can be free of nitro compounds such as nitroguanidine, or highly oxidized complex anions such as hexacyanoferrates. Such compounds could, on the one hand, oxidize Cr(III) present in the coating agent to Cr(VI), which is undesirable in the context of an explicitly Cr(VI)-free coating agent, and could also deteriorate a reducing and inhibiting effect of the peroxo compound or alkynes, which has been described above.

Further preferably, the coating agent is not only free of Cr(VI) but also free of other potentially problematic heavy metal ions such as cobalt, manganese, copper, iron, zinc or nickel ions or, in general, from ions of metals of the fifth period upwards, in particular of molybdenum, vanadium, lead, mercury or tin ions.

Against the background mentioned above, the invention further relates to a method for coating a metal surface using a coating agent according to the invention.

Preferably, the coating agent is applied to the metal surface by spraying, brushing or pouring. These application techniques are different from an immersion method, in which the metal surface is dipped into an immersion bath. For these application techniques, using a coating agent according to the invention is of particular advantage, since the missing possibility of rinsing off and the drying time renders the effects of the peroxo compound particularly valuable. During drying and heating, the peroxo compounds may decompose completely.

Hence, the coating agent according to the invention is preferably a coating agent for application by, for example, spraying, rather than a coating agent for application by immersion.

After drying, preferably air drying, a further coating layer can be applied to the dried and, if necessary, cured coating.

Each or at least the last drying step may be followed by storage for about 5-60 minutes, especially for 10-30 minutes at a temperature greater than 50° C., preferably 100° C. to 150° C.

If the coating agent is a slurry suspension with suspended metal particles, which may be preferred in one embodiment of the invention, it can be a diffusion coating or a compressor coating.

A so-called compressor coating, which in is an exemplary application and configuration of the coating agents herein, the application of the agent to the substrate may be followed by heating to a temperature below the melting point of the metal and, after cooling, conductive blasting with, for example, corundum (aluminum oxide) or glass beads at, for example, 220-300 mesh and 2-3 bar. The metal that is present in the coating agent is part of an additive surface coating also comprising the phosphate, while in so-called diffusion coatings, where the metal is melted and diffuses into the substrate surface, the phosphate binder is not or hardly present in the product.

In a diffusion coating, the application of the coating agent is followed by heat treatment, for example, at temperatures of greater than 500° C., preferably between 880° C. to 1150° C., for several hours. Sandblasting may form a finishing step and remove a metal-depleted coating.

Preferred applications of the coating agent and method of the invention comprise treatments to increase a corrosion resistance of metallic components for the aviation industry, the energy industry, the automotive industry, the oil industry, the metal processing industry and the maritime industry.

The inventive coating agent is configured to yield compact and homogeneous coatings, in contrast to coatings comprising individual crystallites. Preferred coating thicknesses are 1-20 μm for metal powder-free coatings and 10-100 μm for coatings comprising metal powder.

To summarize, the invention proposes a phosphate-comprising coating agent already comprising ions necessary for the crosslinking of the phosphate, for example Al(III), Zn(II), Mg(II) or Cr(III), such that these ions do not have to be drawn from the metal substrate. It is hence a layer-forming agent, which can obtain thick coatings by repeated application, contrary to, for example, compositions for thin-layer phosphating by dipping, where ions for crosslinking the substrate are drawn from the dissolved metal surface. The concentration of phosphate (order of magnitude about 25%) and ions in the agent also differs from concentrations usually found in dipping solutions (order of magnitude about 1%).

The pH of the inventive coating agents an accordingly be somewhat higher than in the state of the art because an etching attack of the substrate surface is neither necessary nor desired. On the other hand, the pH should not become too high since ions present in the coating agent itself may otherwise precipitate. Precipitation is generally undesirable because it would render the coatings dull and unstable.

Figure 2A:
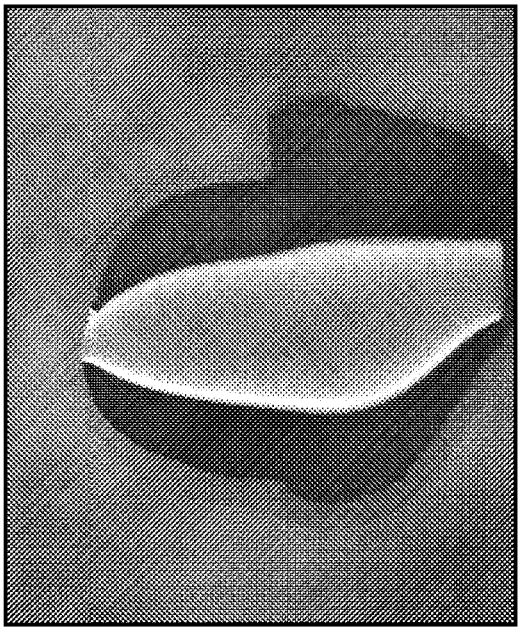
Figure 2B:
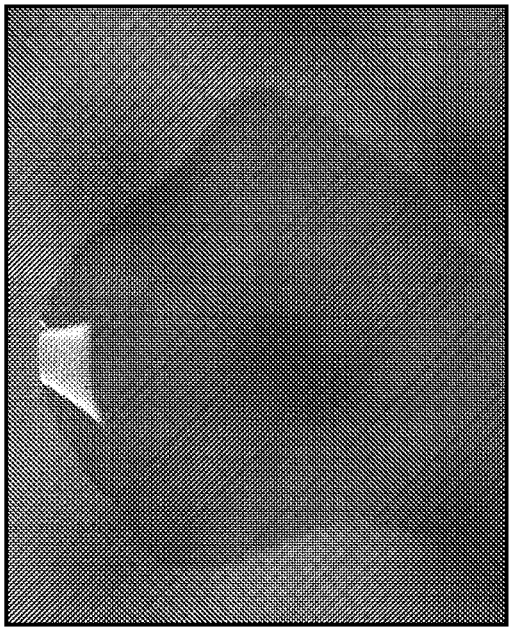
Figure 3A:
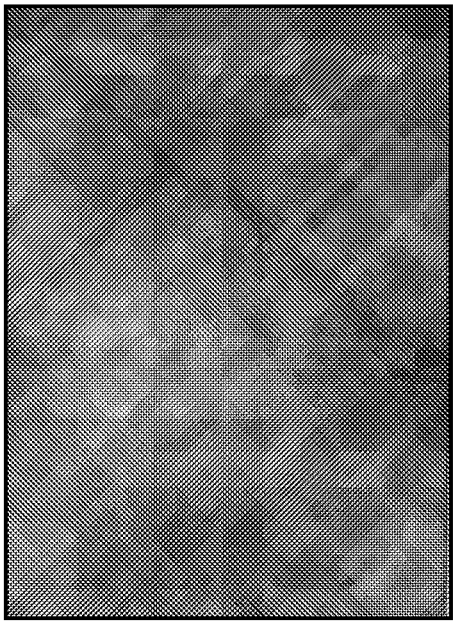
Figure 3B:
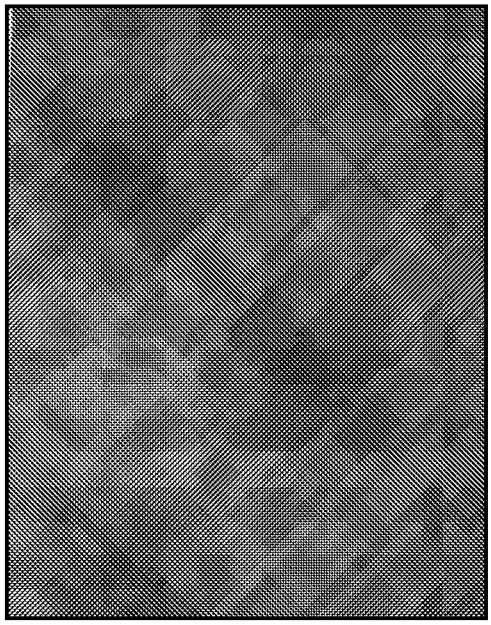
Figure 4A:
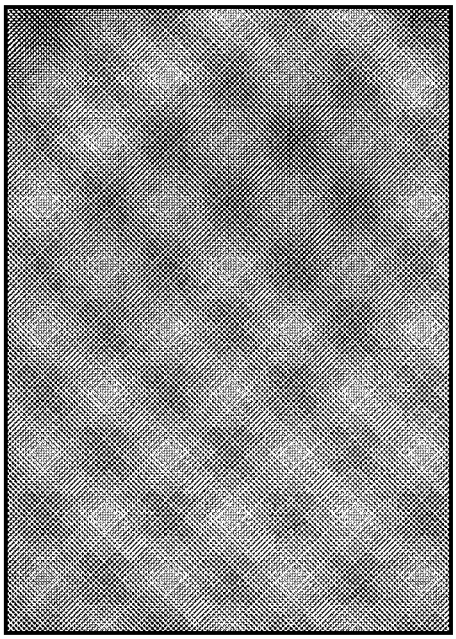
Figure 4B:
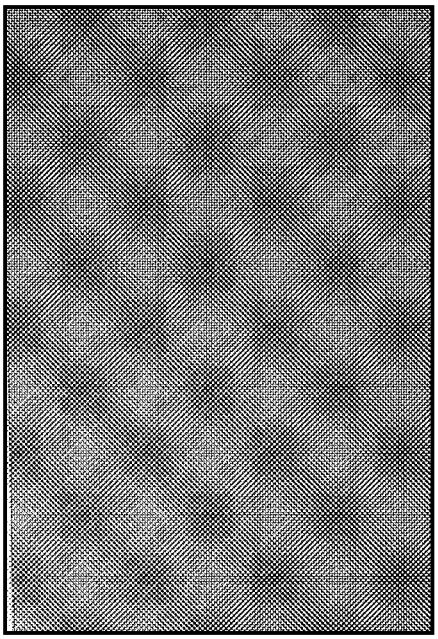
Figure 5A:
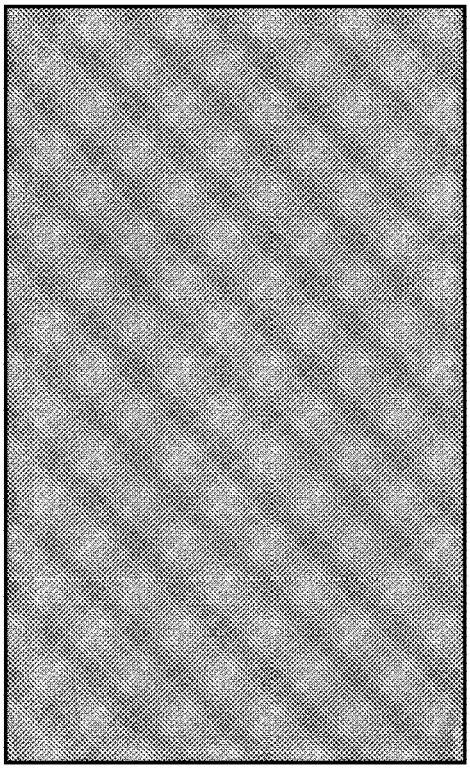
Figure 5B:
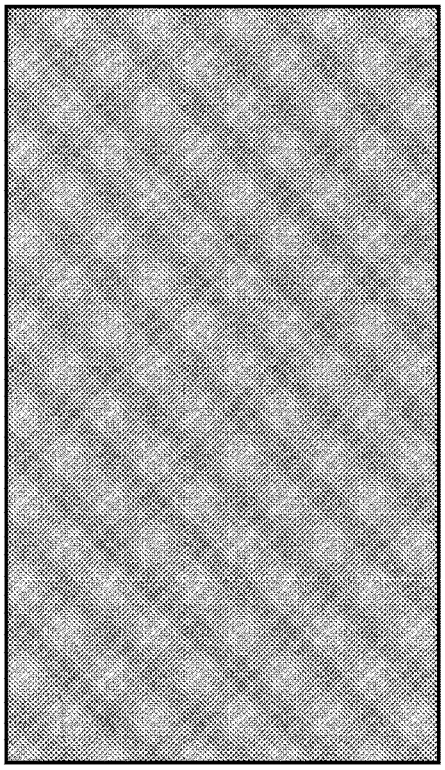
Figure 6A:
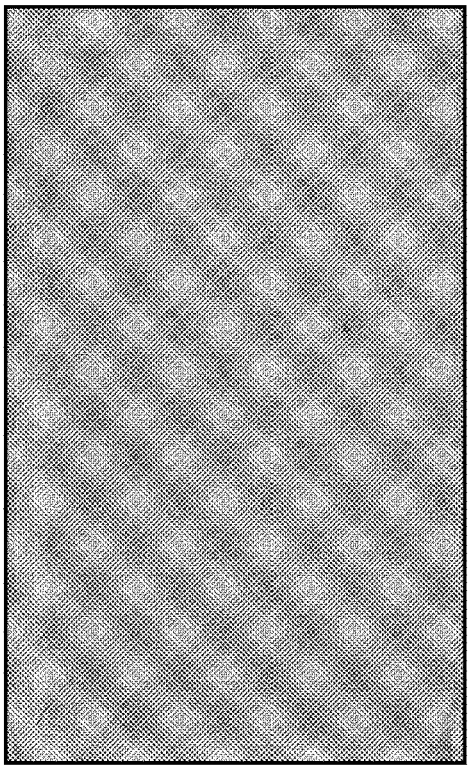
Figure 6B:
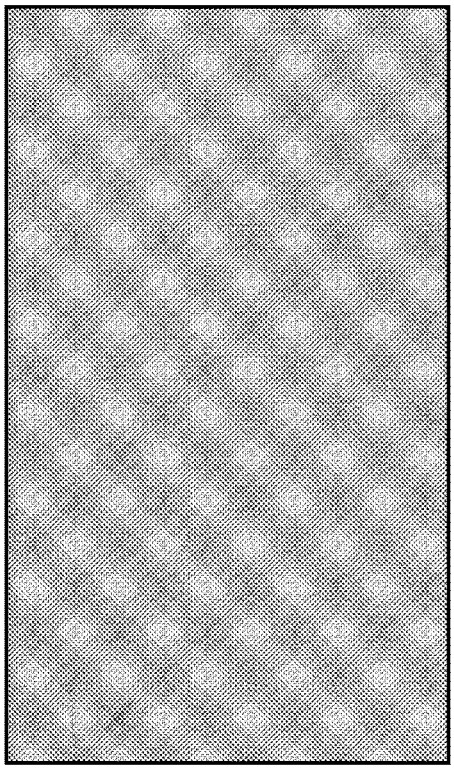
Figure 7A:
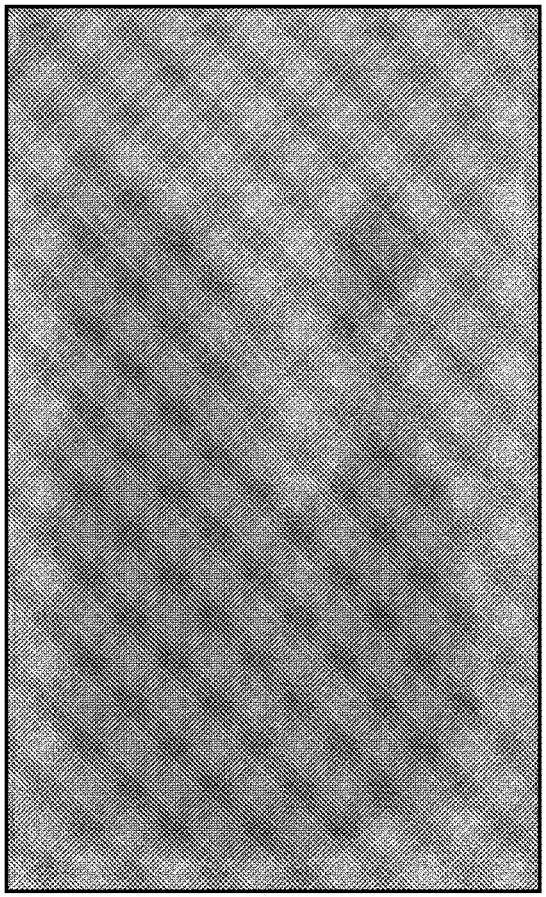
Figure 7B:
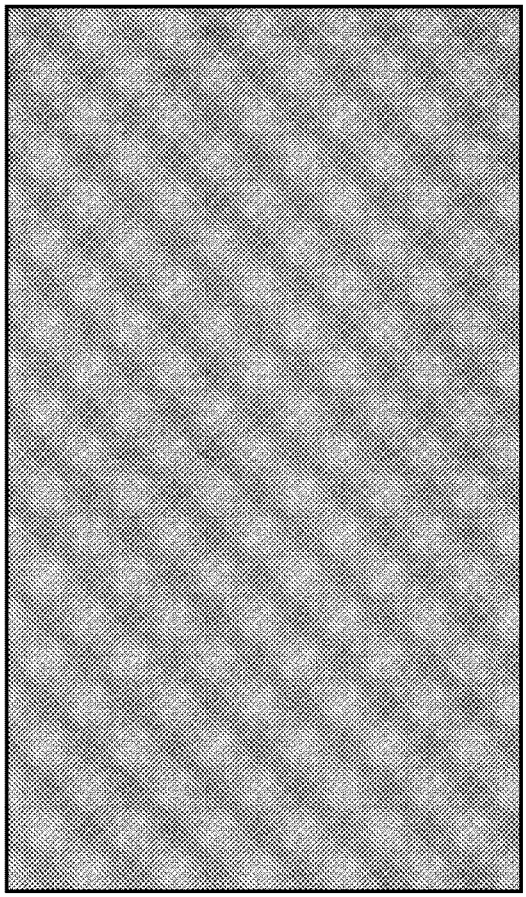

Further details and advantages of the invention will become apparent from the examples described in the following, with reference to the figures. The figures show:

FIGS. 1*a*-1*b*: pictures of phosphate-based base coatings with and without peroxo compound after application;

FIGS. 2*a*-2*b*: pictures of the coatings of FIGS. 1*a*-1*b* during water exposure;

FIGS. 3*a*-3*b*: pictures of the coatings of FIGS. 2*a*-2*b* after water exposure;

FIGS. 4*a*-4*b*: pictures of the coatings of FIGS. 3*a*-3*b* after mechanical abrasion;

FIGS. 5*a*-5*b*: pictures of phosphate-based aluminum slurries with and without peroxo compound after application;

FIGS. 6*a*-6*b*: pictures of the coatings of FIGS. 5*a*-5*b* after baking at 350° C.; and FIGS. 7*a*-7*b*: pictures of the coatings of FIGS. 6*a*-6*b* after conductive blasting.

Example 1

Chromium(VI)-free phosphate-based base coating agents with identical compositions except for an addition of the peroxo compound were applied to a mild steel surface, directly or by spraying, and dried.

Both compositions are aqueous solutions of 25 wt. % of chromium(VI)-free acid phosphate salts with a pH of about 2.5. The inventive variant comprises 2.5 wt. % of disodium peroxide in the solution.

The results are shown in FIGS. 1*a* (without peroxo compound) and 1*b* (inhibited with peroxo compound, according to the invention). The appearance of the non-inhibited coating is dull and yellow-green. The surface is relatively rough. The appearance of the inventively inhibited coating is glossy, dark green and smooth.

FIGS. 2*a* (without peroxo compound) and 2*b* (inhibited with peroxo compound, according to the invention) illustrate the behavior of the coatings upon contact with water. While the non-inhibited coating clearly changes appearance and is penetrated by water, there are no visible changes for the inhibited coating.

FIGS. 3*a* (without peroxo compound) and 3*b* (inhibited with peroxo compound, according to the invention) show the coatings after water contact. While the non-inhibited coating shows a water spot, there are no visible changes for the inhibited coating.

Lastly, FIGS. 4*a* (without peroxo compound) and 4*b* (inhibited with peroxo compound, according to the invention) illustrate an abrasion behavior after water contact, in the form of the coatings of FIGS. 3*a* and 3*b* after mechanical abrasion treatment. The non-inhibited system was severely damaged, there are no visible changes for the inhibited coating.

Example 2

Chromium(VI)-free phosphate-based aluminum slurries with identical compositions except for an addition of the peroxo compound were applied to a mild steel surface and dried.

The slurries were obtained by mixing 55 wt % of the non-inhibited or inhibited base coating agents of Example 1 and 45 wt % of metallic aluminum powder.

The results are shown in FIGS. 5*a* (without peroxo compound) and 5*b* (inhibited with peroxo compound, according to the invention). The appearance of the non-inhibited coating is rough, porous and discolored, with visible bubbles and pores on the surface. The appearance of the inventively inhibited coating is compact, flat and homogeneous. The film thickness of the non-inhibited coating is 74 μm, as opposed to 45 μm for the inhibited coating, indicating the difference in porosity and compactness.

FIGS. 6*a* (without peroxo compound) and 6*b* (inhibited with peroxo compound, according to the invention) illustrate the behavior of the coated surface after baking at 350° C. While the damage to the non-inhibited coating already described in connection with FIG. 5*a* is emphasized, the inhibited system remains compact, flat and homogeneous.

FIGS. 7*a* (without peroxo compound) and 7*b* (inhibited with peroxo compound, according to the invention) show the coatings shown in FIGS. 6*a* and 6*b*, respectively, after conductive blasting with corundum. While the non-inhibited system was severely damaged and ablated, the inhibited system remained intact. The measured electrical resistivity of the coating in the case of FIG. 7*a* is greater than 12Ω, and in the case of FIG. 7*b* is only 0.5Ω.

The invention claimed is:

1. A coating agent for coating acid-sensitive metal surfaces, which is an aqueous solution of an acidic phosphate binder, wherein the coating agent comprises a peroxo compound and is free of chromium (VI) salts and the coating agent further comprises an alkyne or cycloalkyne, the concentration of the alkyne or cycloalkyne being at least 0.01 wt. %.

2. The coating agent according to claim 1, wherein the peroxo compound is a peroxo salt, a peroxo acid or the salt of a peroxo acid, and/or that the concentration of the peroxo compound in the coating agent is at least 0.1 wt. %.

3. The coating agent according to claim 1, wherein the concentration of phosphate salts in the coating agent is greater than 5 wt. %.

4. The coating agent according to claim 1, wherein the pH of the coating agent is from pH 1.5 to pH 4.0.

5. The coating agent according to claim 1, wherein the acidic phosphate binder comprises acidic monohydrogen or dihydrogen phosphates of one or more cations selected from the group consisting of aluminum, magnesium, chromium (III) and/or zinc.

6. The coating agent according to claim 1, wherein the coating agent is free of volatile organic solvents.

7. The coating agent according to claim 1, wherein the coating agent is a slurry suspension further comprising a metal powder suspended in the aqueous solution of the acidic phosphate binder.

8. The coating agent according to claim 1, wherein the coating agent further comprises a reducing agent.

9. The coating agent according to claim 1, wherein the coating agent further comprises a ceramic pigment and/or dispersed PTFE particles.

10. The coating agent according to claim 1, wherein the coating agent is free of nitro compounds, and of highly oxidized complex anions.

11. The coating agent according to claim 1, wherein the peroxo compound is a perborate, a perphosphate or a percarbonate, hydrogen peroxide or an organic peroxo compound.

12. The coating agent according to claim 1, wherein the peroxo compound has a concentration in the coating agent of between 0.5 wt. % and 10 wt. %.

13. The coating agent according to claim 1, wherein the concentration of phosphate salts in the coating agent is greater than 15 wt. %.

14. The coating agent according to claim 1, wherein the pH of the coating agent is from pH 2.0 to pH 2.7.

15. The coating agent according to claim 1, wherein the concentration of the alkyne or cycloalkyne is between 0.05 wt. % and 0.3 wt. %.

16. A method of coating a metal surface with a coating agent according to claim 1.

17. The method according to claim 16, wherein the coating agent is applied to the metal surface by spraying, brushing or pouring.

18. The method according to claim 17, wherein the coating agent is applied two or more times after intermediate drying in between each application.

19. A method for increasing the corrosion resistance of metallic components for the aviation industry, the energy industry, the automotive industry, the oil industry, the metal processing industry or the maritime industry, said method comprising applying the coating agent of claim 1 to a metal surface.

* * * * *